US005150027A

United States Patent [19]

Suzuki

[11] Patent Number: 5,150,027

[45] Date of Patent: Sep. 22, 1992

[54] MOTOR DRIVE CIRCUIT FOR RADIO-CONTROLLED MODEL

[75] Inventor: Nobuhiro Suzuki, Mobara, Japan

[73] Assignee: Futaba Denshi Kogyo K.K., Mobara, Japan

[21] Appl. No.: 634,503

[22] Filed: Dec. 27, 1990

[30] Foreign Application Priority Data

Dec. 27, 1989 [JP] Japan ..... 1-149392[U]

[51] Int. Cl.[5] ..... G11B 17/22

[52] U.S. Cl. ..... 318/581; 318/599; 341/110; 446/454; 180/167

[58] Field of Search ..... 341/110; 446/454, 456; 318/581, 599, 432, 811, 809; 180/167

[56] References Cited

U.S. PATENT DOCUMENTS

| | | | |
|---|---|---|---|
| 4,149,256 | 4/1979 | Sumi et al. | 341/110 |
| 4,763,057 | 8/1988 | Danz et al. | 318/809 |
| 4,956,590 | 9/1990 | Phillips | 318/432 |
| 4,962,976 | 10/1990 | Takahashi et al. | 318/811 |
| 4,964,837 | 10/1990 | Collier | 446/456 |

*Primary Examiner*—William M. Shoop, Jr.
*Assistant Examiner*—John W. Cabeca
*Attorney, Agent, or Firm*—Oblon, Spivak, McClelland, Maier & Neustadt

[57] ABSTRACT

A motor drive circuit for a radio-controlled model capable of readily varying any desired part of inclination of the input-output characteristics with a highly simplified circuit arrangement. The motor drive circuit includes an element for converting a signal corresponding to control condition into a digital signal and subjecting the digital signal to weighing processing for every bit thereof.

9 Claims, 4 Drawing Sheets

MOTOR DRIVE CIRCUIT FOR RADIO-CONTROLLED MODEL

BACKGROUND OF THE INVENTION

This invention relates to a motor drive circuit for a radio-controlled model, and more particularly to a motor drive circuit used for driving a motor of a model unit such as, for example, a model electric car.

A pulse stretcher circuit common to a servo IC which has been conventionally used for a motor controller amplifier is disclosed in Japanese Patent Publication No. 48352/1986 and constructed in such a manner as shown in FIG. 4.

More particularly, the conventional pulse stretcher circuit includes a first transistor 20 of which the emitter is grounded and a second transistor 21 of which the base is connected to the collector of the first transistor 20 and the emitter is grounded. A connection P between the collector of the first transistor 20 and the base of the second transistor 21 is grounded through a resistor R1 and a capacitor C1, and between the connection P and a power supply is connected a current source 22. Also, the pulse stretcher circuit includes a resistor connected between the collector of the second transistor 21 and the power supply.

In the pulse stretcher circuit constructed as described above, when a difference signal indicating the difference between a pulse signal fed from a receiver and a one-shot pulse formed within a motor controller is input to the first transistor 20, it stretches the difference signal over a period of time sufficient to cause a motor of a controlled mode to be actually driven, to thereby generate an output signal. More specifically, the variation of either the resistor R1 or the capacitor C1 permits the relationship between the difference signal and the output signal to be varied, so that the signal extended by the pulse stretcher circuit is subject to power amplification to drive the motor.

The pulse stretcher circuit described above employs the charge discharge characteristics of the capacitor to stretch the difference signal. Thus, the circuit permits the whole inclination of the input-output characteristics expressed when the pulse width of the difference signal is indicated on an X axis and the pulse width of the difference signal after it has been stretched is indicated on a Y axis to be freely varied. However, it fails to vary only the portion of the inclination within any specific range. For example, it fails to permit the pulse width of the difference signal to render only the portion of the inclination within a specific region steep or gentle.

This causes a manipulator to fail to sufficiently maintain a control region extending between an intermediate speed and a maximum speed which is most required during the controlling of a model electric car or the like, so that the conventional pulse stretcher circuit fails to exhibit satisfactory controllability when delicate controlling is required as in a race or the like.

SUMMARY OF THE INVENTION

The present invention has been made in view of the foregoing disadvantage of the prior art.

Accordingly, it is an object of the present invention to provide a motor drive circuit for a radio-controlled model which is capable of partially varying the inclination of the input-output characteristics as desired to facilitate the controlling of a model unit in a rotation region most required.

It is another object of the present invention to provide a motor drive circuit for a radio-controlled model which is capable of accomplishing the above-described object while significantly decreasing the manufacturing costs.

It is a further object of the present invention to provide a motor drive circuit for a radio-controlled model which is capable of accomplishing the above-described objects with a highly simplified circuit arrangement and without requiring a transmitter provided with any specific function.

In accordance with the present invention, there is provided a motor drive circuit for a radio-controlled model comprising a means for converting a signal corresponding to a control condition into a digital signal and subjecting the digital signal to weighing processing for every bit thereof to optionally vary the inclination of the input-output characteristics.

In the present invention constructed as described above, when a manipulator controls a transmitter, a signal generated from the transmitter in correspondence to the control condition is received by a receiver. The received signal is then converted into a digital signal and thereafter subject to weighing processing, resulting in any desired portion of the input-output characteristics being optionally varied as desired.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein.

DETAILED DESCRIPTION OF THE PREFERRED EMBODIMENT

Figure 2:
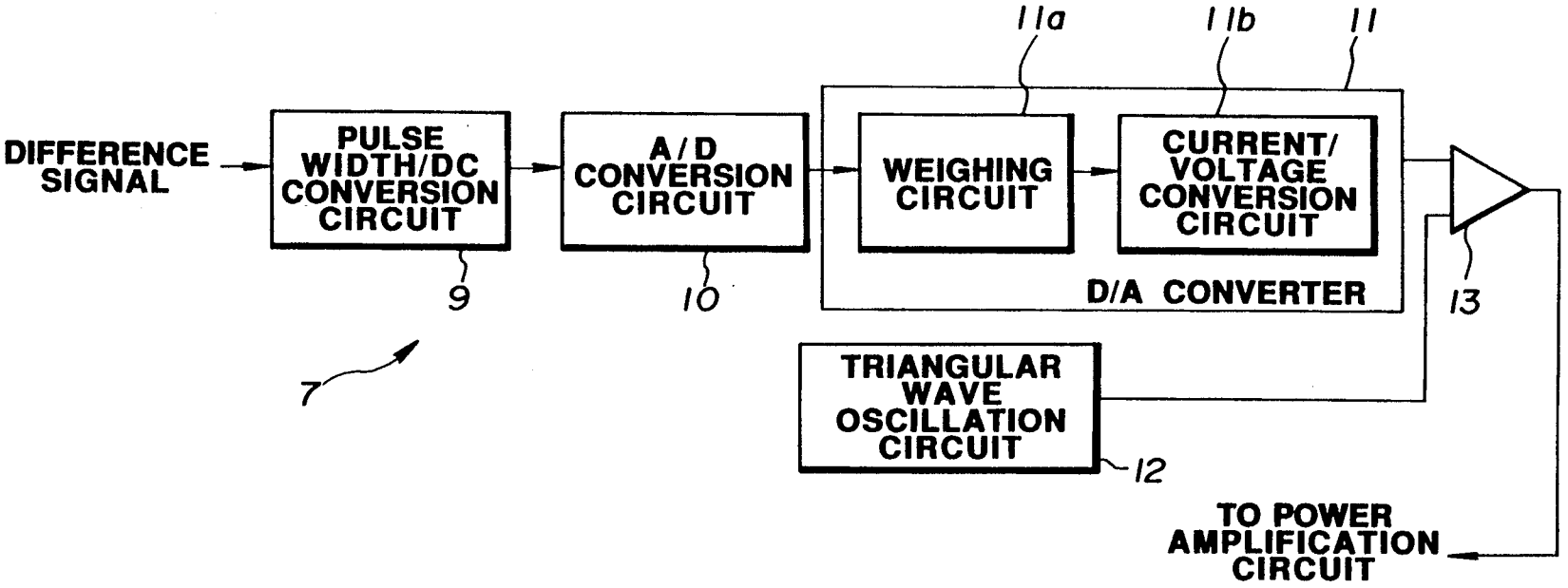
FIG. 2 is a block diagram showing a pulse width conversion circuit.
Figure 3:
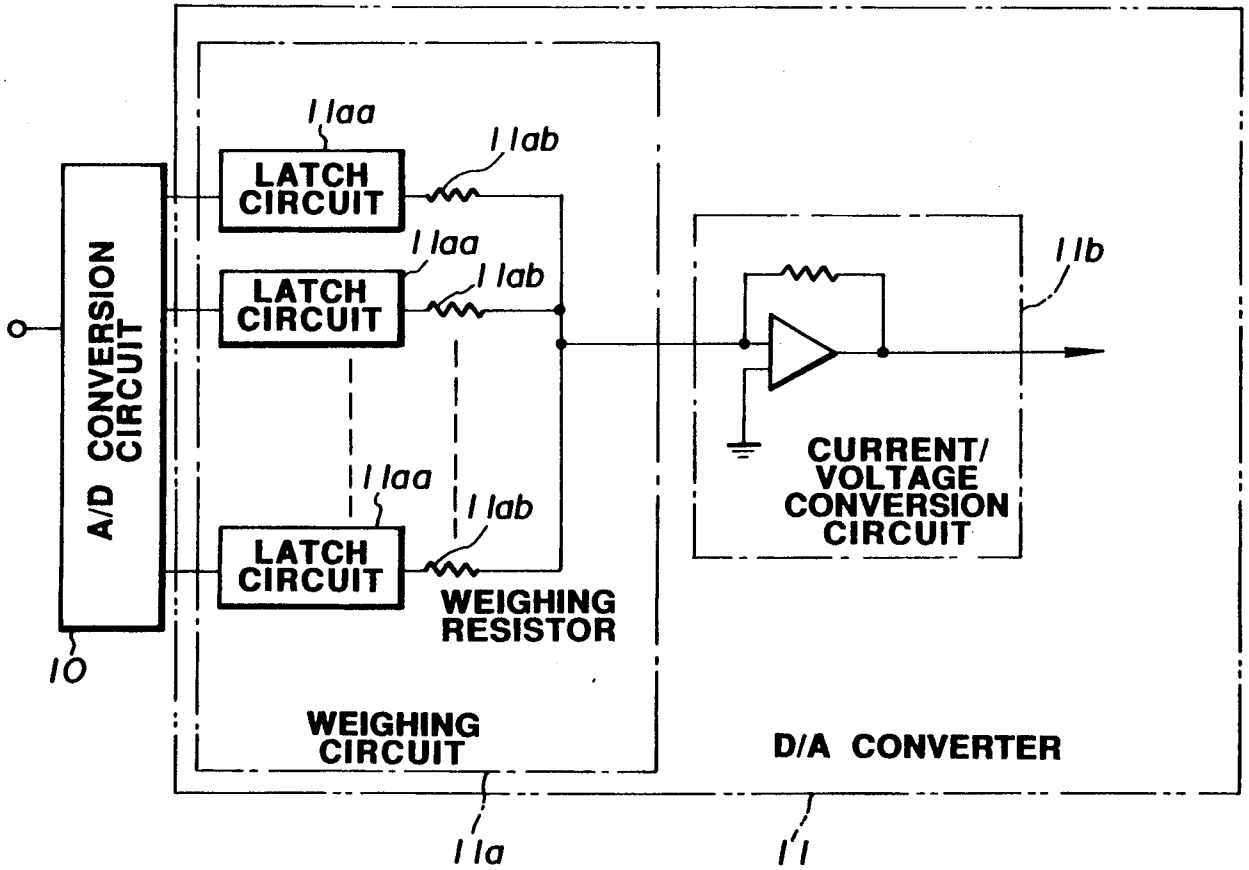
FIG. 3 is a block diagram showing a circuit of a D/A converter.
Figure 4:
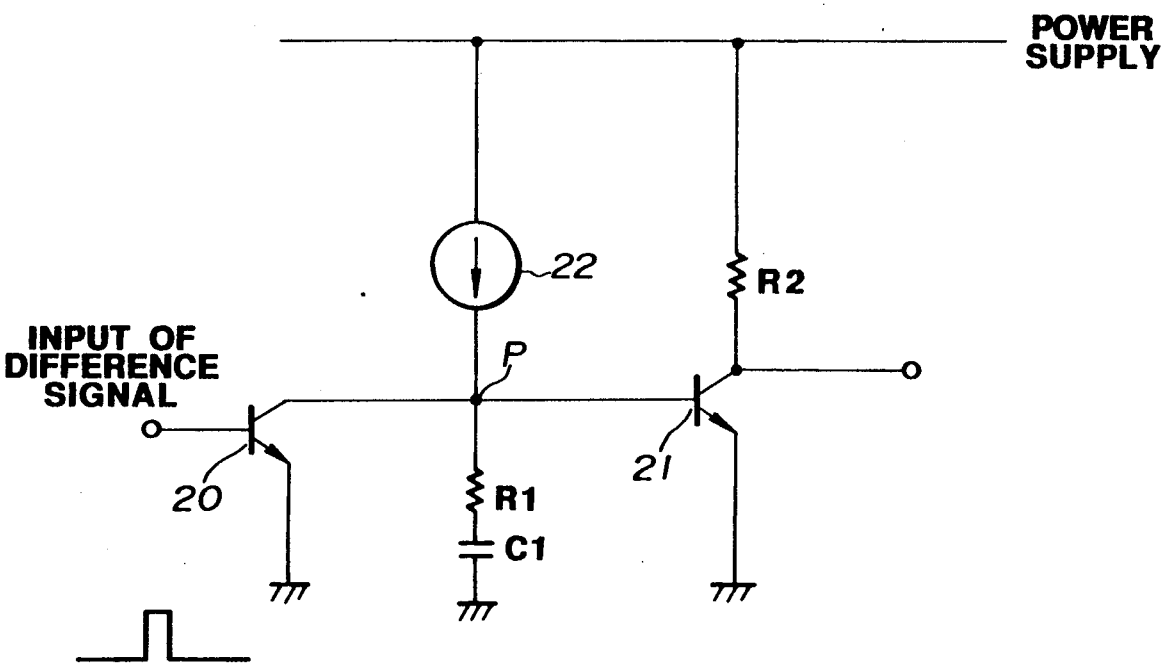
FIG. 4 PRIOR ART
FIG. 4 is a circuit diagram showing a conventional pulse stretcher circuit common to a servo IC used for a motor controller amplifier.

Now, a motor drive circuit for a radio-controlled model according to the present invention will be described hereinafter with reference to FIGS. 1 to 3, wherein like reference numerals designate like or corresponding parts throughout.

Figure 1:
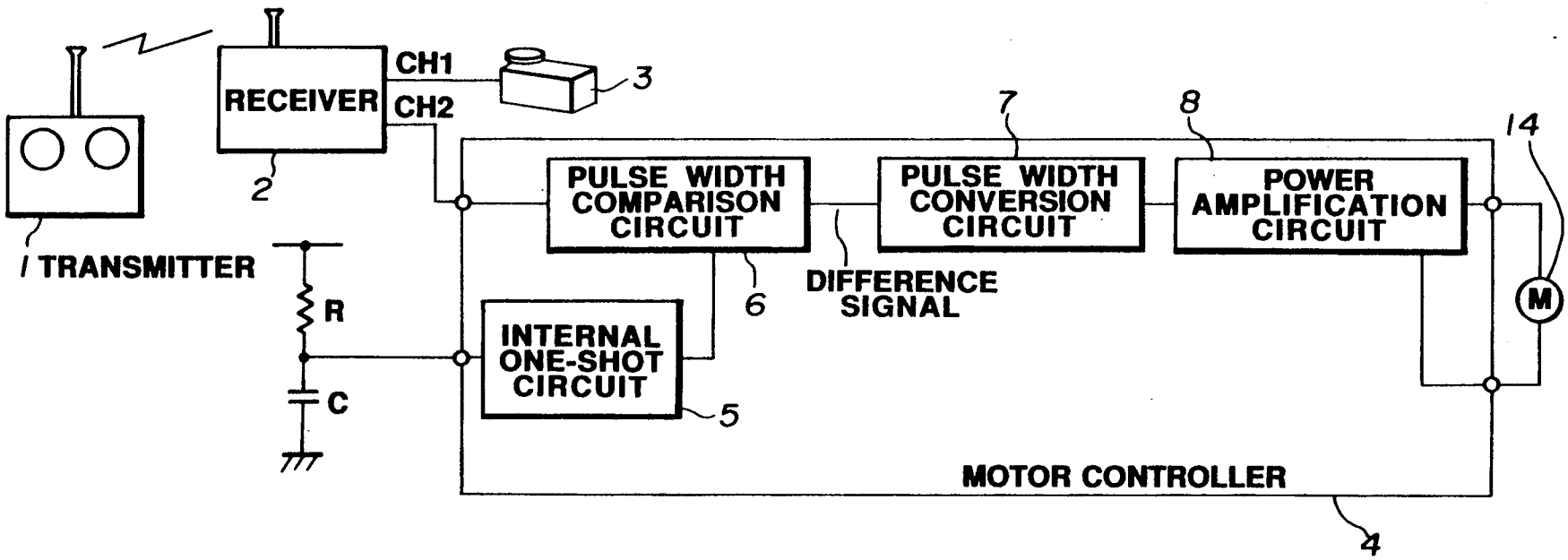
FIG. 1 is a block diagram generally showing a model controlling device to which an embodiment of a motor drive circuit for a radio-controlled model according to the present invention may be applied.

FIG. 1 illustrates a model controlling device to which an embodiment of a motor drive circuit for a radio-controlled model according to the present invention may be applied. A motor drive circuit of the illustrated embodiment is adapted to control the drive of a motor of a model controlling device for controlling a model unit such as, for example, a model electric car or the like.

A model controlling device to which the embodiment is applied includes a transmitter 1, a receiver 2, a steering servo 3 and a motor controller 4. The motor controller 4 includes an internal one-shot circuit 5, a pulse width comparison circuit 6, a pulse width conversion circuit 7 and a power amplification circuit 8.

The transmitter 1 is adapted to generate a pulse train signal of a predetermined wavelength depending upon the operation of a stick by a manipulator, to thereby control a controlled unit in a desired direction.

The receiver 2 includes a wave detection circuit and a decoder and is so constructed that the wave detection circuit detects a signal fed from the transmitter 1 to demodulate various control signals of, for example, about 50 Hz and the decoder divides the control signals into signals for channels, that is, a signal for controlling a motor and that for operating a handle to feed the handle operating signal to the steering servo 3 and feed the motor controlling signal to the pulse width comparison circuit 6, resulting in being transmitted as pulse width information for every cycle of, for example, 14 to 22 msec.

The steering servo 3 produces a drive signal for operating the handle from various control signals fed from the receiver 2. The drive signal acts to control the inclination of the wheels of a controlled unit to a predetermined angle to control the direction of advance of the controlled unit such as right-turn, left-turn or the like.

The internal one-shot circuit 5 serves to feed a reference pulse set therein to the pulse width comparison circuit 6.

The pulse width comparison circuit 6 is adapted to compare a signal of about 50 Hz input thereto from the receiver 2 with the reference pulse produced in synchronism with the input signal and fed from the internal one-shot circuit 5 to prepare the difference therebetween, so that a signal corresponding to forward movement or rearward movement based on, for example, the trailing of the reference pulse may be output as a difference signal to the pulse width conversion circuit 7.

The pulse width conversion circuit 7 functions to convert a variation of the difference signal varied depending upon the width of a pulse input thereto from the pulse width comparison circuit 6. For this purpose,, the pulse width conversion circuit 7, as shown in FIG. 2, includes a pulse width/DC conversion circuit 9, an A/D conversion circuit 10, a D/A converter 11, a triangular wave oscillation circuit 12, and a comparison circuit 13.

The pulse width/DC conversion circuit 9 converts the pulse width (time) of the difference signal fed from the pulse width comparison circuit 6 into a DC voltage signal corresponding thereto to feed it to the A/D conversion circuit 10.

The A/D conversion circuit 10 acts to convert the DC voltage signal of an analog form fed from the pulse width/DC conversion circuit 9 into a digital signal of, for example, sixteen stages to deliver it to the D/A converter 11.

The D/A converter 11 includes a weighing circuit 11*a* and a current/voltage conversion circuit 11*b*. The weighing circuit 11*a*, as shown in FIG. 3, includes latch circuits 11*aa* and weighing resistors 11*ab* corresponding in number to the number of bits of a signal generated from the pulse width/DC conversion circuit 9. The so-constructed weighing circuit 11*a* is adapted to latch the digital signal of sixteen stages fed from the A/D conversion circuit 10 by means of the latch circuits 11*aa*, respectively, to thereby cause a variation of the difference signal varied out weighing processing of the digital signal for every bit of the digital signal.

The resistance of each of the weighing resistors 11*ab* is set so as to have a predetermined value depending upon a curve of input-output characteristics desired and currents flowing through the weighing resistors 11*ab* are added to each other and then fed to a non-invention input terminal of a differential-type amplifier constituting the current/voltage conversion circuit 11*b*.

The current/voltage conversion circuit 11*b* converts a value of a current fed from the weighing circuit 11*a* into a voltage value, which is then fed to a non-inversion input terminal of a comparator constituting the comparison circuit 13.

The triangular wave oscillation circuit 12 acts to produce a triangular wave of a predetermined frequency (for example, 5 kHz) depending upon an oscillation signal fed from an oscillator and feeds it to the non-inversion input terminal of the comparison circuit 13, which then compares a voltage signal fed from the current/voltage conversion circuit 11*b* with a voltage of the triangular wave fed from the triangular wave oscillation circuit 12 to feed, to the power amplification circuit 8, a signal of a pulse width corresponding to the output of the triangular wave obtained over a period of time during which the voltage signal from the current-/voltage conversion circuit 11*b* is high as compared with the voltage of the triangular wave. The input signal from the receiver 2, as described above, has a frequency of about 50 Hz and the triangular wave has a frequency of about 5 kHz, resulting in the signal input to the power amplification circuit 8 having a high frequency of about 5 kHz. This permits a number of pulses to be used for drive the motor even when the difference signal has a small pulse width, so that fine driving may be accomplished while withstanding an inertia force of the motor.

The power amplification circuit 8 serves to amplify the signal fed from the comparison circuit 13 and feed a drive current to a DC motor 14 in order to ensure desired controlling of a model unit depending upon the output of the transmitter 1.

Now, the manner of operation of the motor drive circuit of the illustrated embodiment constructed as described above will be described hereinafter.

When a manipulator operates a stick of the transmitter 1, signals of a predetermined wavelength corresponding to the operation of the stick are output from the transmitter 1. The so-output signals are then received by the receiver 2, which divides the signals into a signal for controlling the motor and that for operating the handle. The handle operating signal is fed to the steering servo 3, which then moves wheels of a controlled unit to a predetermined angle depending upon the signal fed thereto.

The motor controlling signal is fed to the pulse width comparison circuit 6, which compares it with a reference signal fed from the internal one-shot circuit 5 to feed a difference signal corresponding to the forward movement or rearward movement of the controlled unit to the pulse width conversion circuit 7. The conversion circuit 7 converts the difference signal into a DC voltage corresponding to the pulse width of the difference signal and then converts it into a digital signal of sixteen stages, which is then fed to the D/A converter 11. The D/A converter 11 subjects the digital signal of sixteen stages to weighing processing for every bit of the digital signal by means of the weighing resistors 11*ab*, so that currents flowing through the weighing resistors 11*ab* are added together and then fed to the comparison circuit 13. The comparison circuit 13 carries out the comparison between a voltage signal from the current/voltage conversion circuit 11*b* and a triangular wave from the triangular wave oscillation circuit 12 to feed a signal of a pulse width corresponding to the output of the triangular wave obtained for a period of time during which the voltage signal is kept high as compared with the triangular wave to the power amplification circuit 8. The power amplification circuit 8 provides the DC motor 14 with a drive current depending upon the signal fed from the comparison circuit 13, so that the controlled or model unit may be controlled corresponding to the output of the transmitter.

Thus, in the illustrated embodiment, the pulse width conversion circuit 7 subjects the difference signal based on the digital signal corresponding to the output from the transmitter and subjected to A/D conversion to the weighing processing for every bit of the digital signal to carry out fine adjustment of the value of the current flowing through each of the weighing resistors 11*ab*, so that the currents flowing therethrough are added together and then converted to the voltage signal again. Then, the voltage signal is compared with the triangular wave to generate the PWM signal, to thereby control the driving of the DC motor 14. Thus, the inclination of the input-output characteristics can be optionally varied as desired by setting the resistance of each of the weighing resistors 11*aa* in correspondence to the input-output characteristics required. This results in the control region for controlling a model unit being sufficiently maintained, to thereby facilitate controlling of the model unit in a rotation region which is required most. Also, this permits the motor drive circuit of the illustrated embodiment to be free from a function of a conventional transmitter of high quality of carrying out pseudo-control of a motor by means of an exponential curve, so that the motor control device may effectively control a motor even when an inexpensive transmitter is used.

In the illustrated embodiment, the conversion of a signal converted into a DC voltage into a digital signal has been illustratively described in connection with the digital signal of sixteen stages. However, the number of stages of the digital signal may be varied depending upon the performance of a controlled unit, therefore, the digital signal is not limited to any specific number of stages. Also, the above description has been made in connection with the weighing resistors 11*aa* each having a resistance previously fixedly set in correspondence with the input-output characteristics. However, the weighing resistors each may comprise a variable resistor, which may be variably controlled depending upon the input-output characteristics.

As can be seen from the foregoing, the motor drive circuit of the present invention can vary any desired part of inclination of the input-output characteristics with a highly simplified circuit arrangement and without requiring a transmitter with any specific function as in the prior art, to thereby facilitate motor control in a rotation region most required when a model unit is controlled.

While a preferred embodiment of the invention has been described with a certain degree of particularity with reference to the drawings, obvious modifications and variations are possible in light of the above teachings. It is therefore to be understood that within the scope of the appended claims, the invention may be practiced otherwise than as specifically described.

What is claimed as new and desired to be secured by Letters Patent of the United States is:

1. A motor drive circuit for a radio-controlled model comprising:

an internal one-shot circuit for generating a reference signal;

a pulse width comparison circuit for comparing an input signal for controlling a motor with said reference signal produced in synchronism with said input signal and generating a difference signal between said input signal and said reference signal;

a pulse width conversion circuit for converting said difference signal into a digital signal having a plurality of bits and subjecting said digital signal to weighing processing for every bit thereof to optimally vary an inclination of input and output characteristics of said motor drive circuit; and a power amplification circuit for amplifying a signal generated from said pulse width conversion circuit and supplying a current for driving said motor in a radio-controlled model unit.

2. A motor drive circuit for a radio-controlled model as defined in claim 1, wherein said pulse width conversion circuit comprises a pulse width/DC conversion circuit, an A/D conversion circuit, D/A converter, a triangular wave oscillation circuit and a comparison circuit.

3. A motor drive circuit for a radio-controlled model as defined in claim 2, wherein said pulse width/DC conversion circuit converts pulse width of said difference signal from said pulse width comparison circuit into an analog DC voltage signal corresponding thereto for transmitting it to said A/D conversion circuit.

4. A motor drive circuit for a radio-controlled model as defined in claim 3, wherein said A/D conversion circuit converts said analog DC voltage signal from said pulse width/DC conversion circuit into a digital signal for transmitting it to said D/A converter.

5. A motor drive circuit for a radio-controlled model as defined in claim 4, wherein said D/A converter comprises a weighing circuit and a current/voltage conversion circuit.

6. A motor drive circuit for a radio-controlled model as defined in claim 4, wherein said weighing circuit comprises latch circuits and weighing resistors corresponding in member to a number of bits of said analog DC voltage signal generated from said pulse width/DC conversion circuit for latching said digital signal form said A/D conversion circuit and subjecting said digital signal to weighing processing for every bit thereof.

7. A motor drive circuit for a radio-controlled model as defined in claim 6, wherein said weighing resistors are set to have a predetermined value depending upon a curve of input-output characteristics to be obtained.

8. A motor drive circuit for a radio-controlled model as defined in claim 2, wherein said triangular wave oscillation circuit generates a triangular wave of a predetermined frequency for transmitting it to said comparison circuit.

9. A motor drive circuit for a radio-controlled model as defined in claim 8, wherein said comparison circuit compares a voltage signal from said D/A converter with said triangular wave from said triangular wave oscillation circuit and transmits a signal having pulse width corresponding to an output of said triangular wave obtained for a period of time during which said voltage signal is kept high as compared with said triangular wave to said power amplification circuit.

* * * * *